United States Patent [19]

Vogler, Jr. et al.

[11] 4,399,660

[45] Aug. 23, 1983

[54] ATMOSPHERIC VAPORIZER

[75] Inventors: William E. Vogler, Jr., Grand Island; Thomas G. Halvorson, Lockport, both of N.Y.

[73] Assignee: Union Carbide Corporation, Danbury, Conn.

[21] Appl. No.: 386,998

[22] Filed: Jun. 10, 1982

Related U.S. Application Data

[63] Continuation of Ser. No. 233,111, Feb. 10, 1981, abandoned.

[51] Int. Cl.[3] ..... F17C 7/02

[52] U.S. Cl. ..... 62/52; 165/179; 165/183

[58] Field of Search ..... 62/50, 52; 165/179, 165/181, 183

[56] References Cited

U.S. PATENT DOCUMENTS

| | | | |
|---|---|---|---|
| 2,322,341 | 1/1940 | Booth | 257/148 |
| 3,124,940 | 9/1961 | Guelton | 62/284 |
| 3,293,871 | 5/1965 | Tyree | 62/52 |
| 3,343,596 | 9/1967 | Kritzer | 165/57 |
| 3,735,465 | 5/1973 | Tibbets et al. | 29/202 D |
| 4,091,634 | 5/1978 | Shepherd | 62/55 |

*Primary Examiner*—Ronald C. Capossela
*Attorney, Agent, or Firm*—Stanley Ktorides

[57] ABSTRACT

An atmospheric vaporizer suitable for vaporizing cryogenic liquids on a continuous basis at greatly improved operating efficiency characterized by a critical pass spacing ratio of from 1 to 5.

13 Claims, 9 Drawing Figures

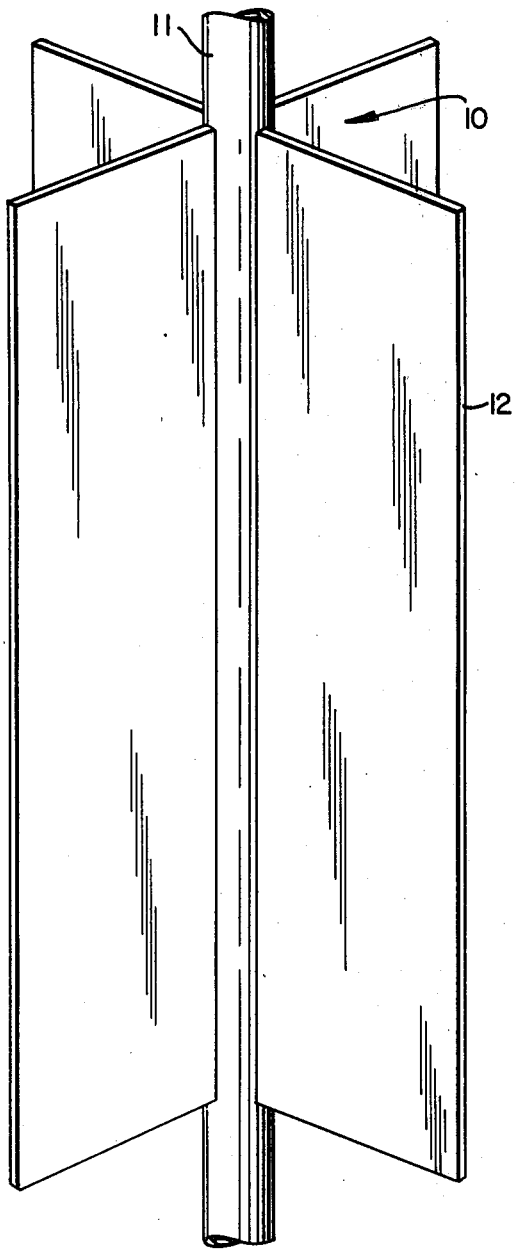
FIG. 1
FIG. 2
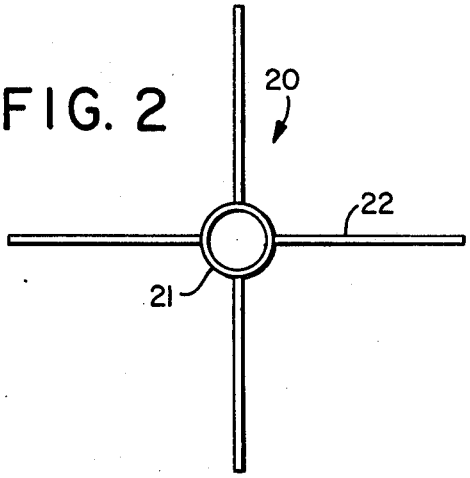
FIG. 3
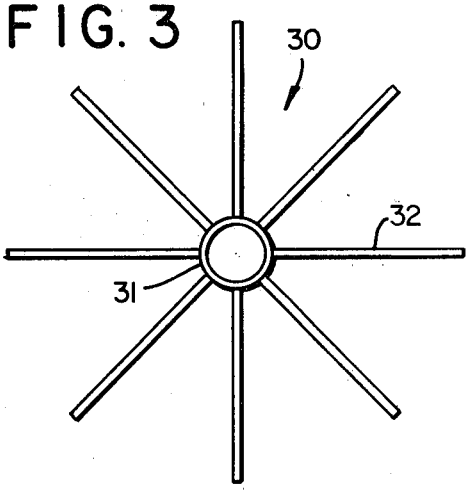
FIG. 4
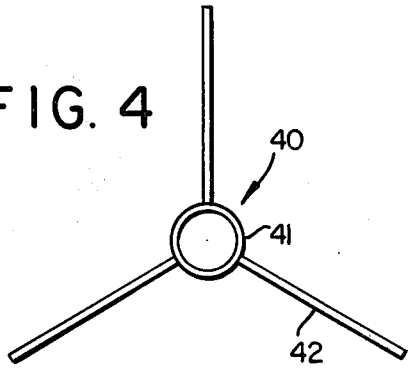

FIG. 5
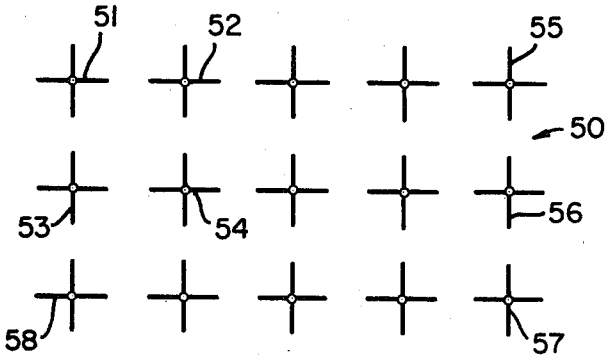
FIG. 6
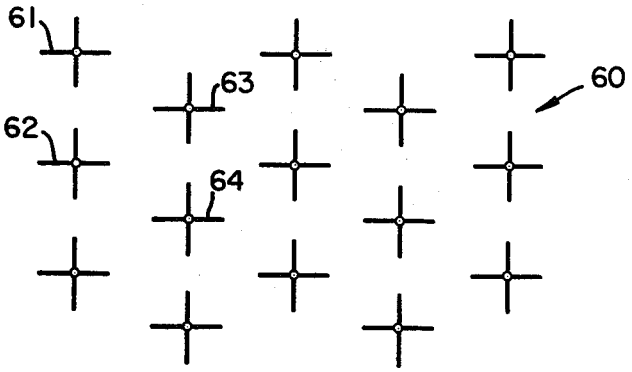
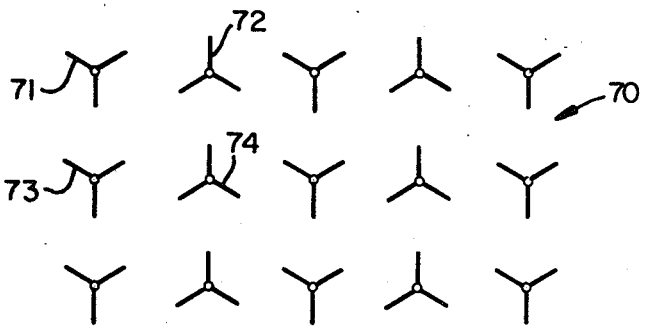
FIG. 7
FIG. 8
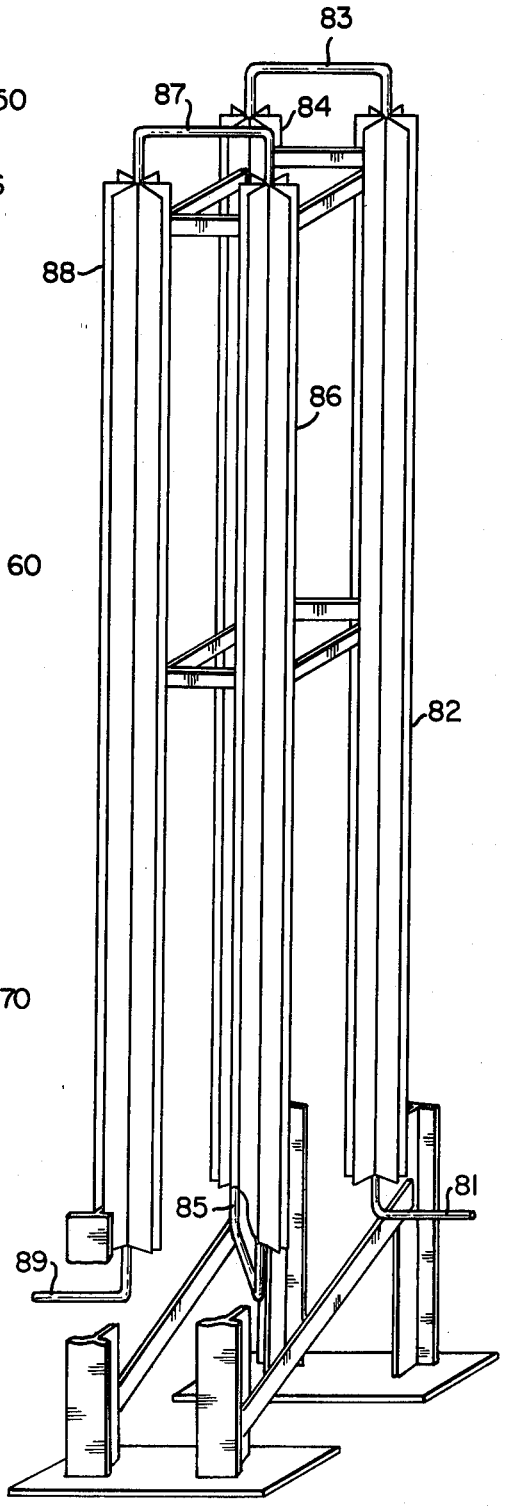

ATMOSPHERIC VAPORIZER

This application is a continuation of our prior U.S. application Ser. No. 233,111, filing date Feb. 10, 1981, now abandoned.

BACKGROUND OF THE INVENTION

This invention relates to an atmospheric vaporizer suitable for vaporizing cryogenic liquids on a substantially continuous basis at greatly improved operating efficiency.

Atmospheric gases such as oxygen, nitrogen and argon find wide use in a variety of applications. These gases are typically produced by means of air separation plants. Users of large quantities of such gases may have air separation units at the site of gas usage, while users of small quantities of such gases generally find it convenient to purchase their requirements in cylinders. Users of intermediate or moderate amounts of such gases generally do not have sufficient usage to justify an on-site air separation plant, but generally their requirements are large enough to make purchasing of gas in cylinders uneconomical. Typically, moderate users of gases will find it convenient to maintain on-site cryogenic liquid storage tanks and vaporize the liquid as requirements dictate. The gas is then piped to the use locations. The usage requirements may be intermittent or continuous.

An atmospheric vaporizer is a device which vaporizes cryogenic liquids by employing heat absorbed from the ambient air. Atmospheric vaporizers have been employed by users of intermediate quantities of gases as means of vaporizing the stored cryogenic liquid when the user's gase requirements are intermittent, but generally not when the user's gas requirements are continuous. The reason why atmospheric vaporizers are not generally used for continuous service is because ice and frost build up on the outside surfaces of the atmospheric vaporizer, rendering the unit inefficient after a sustained period of use.

Typically, an atmospheric vaporizer is comprised of one or more passes vertically positioned and piped together. The passes are comprised of a center tube through which the liquid passes, and the tube generally has one or more fins attached to it to increase the heat transfer area. The passes are spaced about 9.25 inches, centerline to centerline, from each other. The cryogenic liquid enters at the bottom of one pass, passes up through it and then through a connection to the top of another pass through which it descends. This flow pattern is repeated through other passes as conditions such as usage and ambient temperature dictate. As the cryogenic liquid passes through the atmospheric vaporizer, the liquid is vaporized and the gas then further heated by heat transferred from the ambient air to the fluid through the vaporizer. The gas exits the atmospheric vaporizer at the required flow rate and exit temperature.

As the fluid passes through the vaporizer and as heat is exchanged from the ambient air, the moisture in the air condenses and freezes on the surfaces of the vaporizer. This frost and ice continues to build up during operation of the vaporizer resulting in decreasing efficiency until a steady state condition is attained. As the efficiency of the atmospheric vaporizer decreases, either the exit flow rate or the exit temperature or both must be decreased. Depending on the relative importance of these parameters, one or both of them are decreased until the steady state condition is achieved. Typically, this steady state condition is achieved at about 20 percent of the capacity of the vaporizer without the frost buildup.

When the user's requirements are intermittent, the frost buildup is generally not a problem because whatever frost built up does occur during operation melts off or can be easily removed while the unit is not in operation. Under these conditions, the vaporizer is operating efficiently, and the above-mentioned low efficiency steady state is generally not encountered.

However, when the atmospheric vaporizer is operating in the continuous mode, the frost and ice do not get a chance to melt, and the vaporizer is soon operating inefficiently. For this reason, atmospheric vaporizers are generally not preferred for continuous vaporization of stored cryogenic liquids. Instead, a vaporizer is employed which utilizes a source of heat other than or in addition to ambient heat. This source of heat or energy is normally obtained from steam or electricity. Due to the escalating cost of energy, it is desirable to reduce or eliminate the need for a supplementary heat source of the vaporizer. It would be desirable to vaporize stored cryogenic liquid continuously without encountering the heretofore unavoidable drastic decrease in operating efficiency characteristic of atmospheric vaporizers of the prior art.

OBJECTS

Accordingly, it is an object of this invention to provide an improved atmospheric vaporizer for cryogenic liquids.

It is another object of this invention to provide an improved atmospheric vaporizer that is suitable for continuous operation.

It is another object of this invention to provide an improved atmospheric vaporizer that is suitable for continuous operation while substantially avoiding the drastic reduction in operating efficiency characteristic of prior art atmospheric vaporizers.

SUMMARY OF THE INVENTION

The above and other objects which will be apparent to those skilled in the art are achieved by the present invention which comprises an apparatus for continuously vaporizing a cryogenic liquid by employing heat absorbed from the ambient air, said apparatus comprising at least three substantially vertically positioned passes which are piped together, each pass being comprised of a center tube having an outside diameter of from 0.5 to 1.5 inches and provided with 3 to 8 fins substantially equally spaced around said tube, each fin having a radial length of from 1.5 to 7 times the outside diameter of said tube and extending longitudinally along substantially the entire length of said tube, each pass having a length of from 5 to 20 feet and a ground clearance of from 1 to 4 feet, and wherein the ratio of the distance between adjacent fin tips to radial fin length is from 1 to 5.

THE DRAWINGS

FIG. 1 illustrates a typical atmospheric vaporizer pass.

FIG. 2, FIG. 3, and FIG. 4 are each a plan view of a vaporizer pass. FIG. 2 illustrates a pass having four fins, FIG. 3 illustrates a pass having eight fins, and FIG. 4 illustrates a pass having three fins.

FIG. 5, FIG. 6, and FIG. 7 are each a plan view of a vaporizer pass array. FIG. 5 illustrates a square array of four-finned passes, FIG. 6 illustrates a triangular array of four-finned passes, and FIG. 7 illustrates a square array of three-finned passes.

FIG. 8 illustrates one embodiment of the atmospheric vaporizer of this invention.

DETAILED DESCRIPTION OF THE INVENTION

Figure 9:
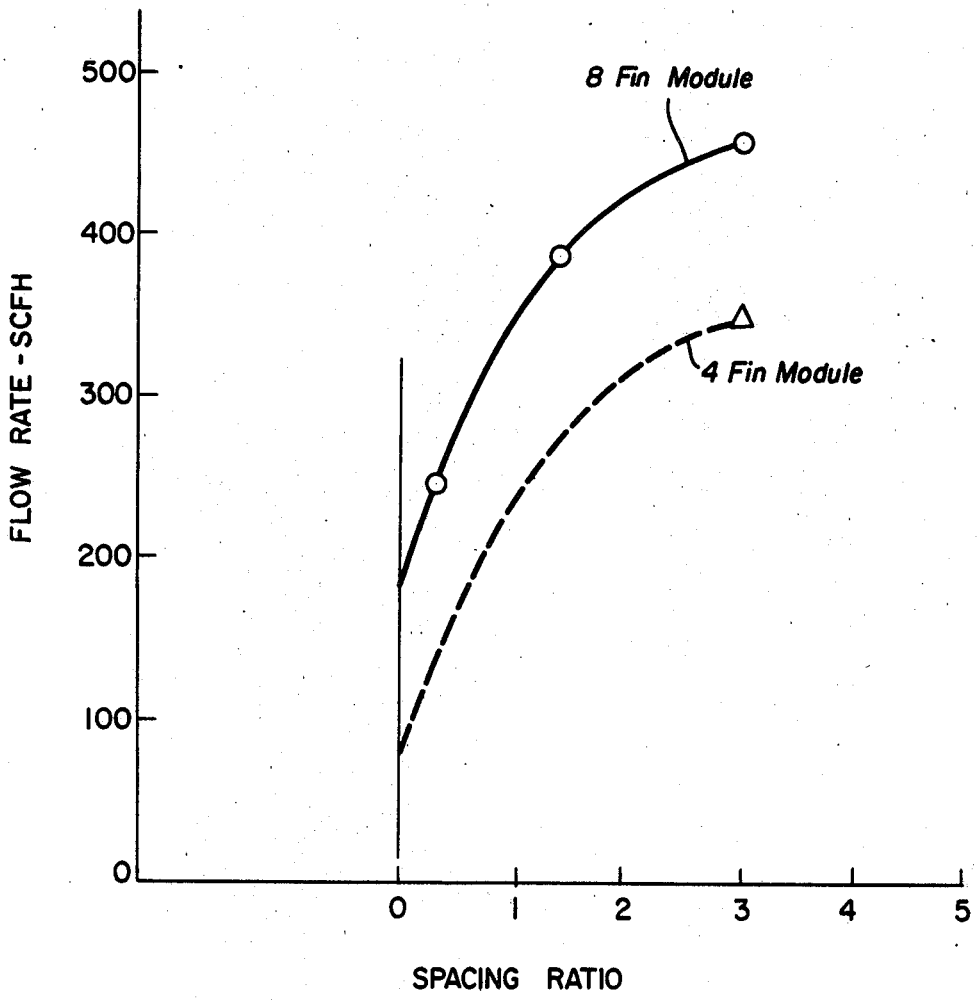
FIG. 9 is a graphical representation of steady state flow rate versus spacing ratio.

The atmospheric vaporizer of this invention is comprised of three or more finned passes piped together and arranged in an array having defined spacing in between individual passes.

FIG. 1 illustrates a typical pass 10 comprising a center tube 11 and fins 12. The center tube has an outside diameter of from 0.5 to 1.5 inches (1.27 to 3.81 cm), preferably about 1 inch (2.54 cm), and is of sufficient thickness to contain the fluid at the requisite supply pressure. The cryogenic fluid passes through the center tube as it passes through the vaporizer. The fins 12 extend from the tube in radial fashion and extend longitudinally along the tube for substantially the entire length of the tube. The fins normally have a radial length of from 1.5 to 6 times the diameter of the tube, preferably about 3.5 times the diameter of the tube. The fin thickness is not critical, and is generally sufficient to obtain adequate mechanical strength to permit support of the unit in an upright position with suitable brackets and leg supports. Generally, the fin thickness is from 1/16 to ⅛ inch (0.16 to 0.32 cm); a convenient thickness is 1/10 inch (0.25 cm). The number of fins can range from 3 to 8 fins per pass. FIG. 1 illustrates a four-fin arrangement. The fins are spaced substantially equidistant around the center tube. Thus, for the four-finned tube 20 shown in FIG. 2 the fins 22 are arranged around the center tube 21 at about 90° from each other. For the eight-finned tube 30 shown in FIG. 3, the fins 32 are arranged around the center tube 31 at about 45° from each other. And for the three-finned tube 40 shown in FIG. 4, the fins 42 are arranged around the center tube 41 at about 120° from each other.

Each pass has a length of from 5 to 20 feet (1.52 to 6.08 m), preferably from 8 to 16 feet (2.44 to 4.88 m), most preferably about 12 feet (8.66 m). The fins extend along the length of the center tube substantially from end to end; however, there is a small length at both the top and bottom of the tube where the fins do not extend so as to permit connecting of the passes together. The passes are connected together in any suitable manner; a convenient method of connecting is by use of U-bend joints.

The passes may be constructed from any material having good heat transfer characteristics. Aluminum is the preferred material. When high pressure is required, the center tube may be fabricated from stainless steel or monel and fitted with the aluminum fins.

The passes are usually set on the ground, positioned vertically and held in place by suitable leg supports. Normally, the passes have a ground clearance of from about 1 to 4 feet (0.03 to 1.2 m), preferably from about 1.5 to 3 feet (1.46 to 0.92 m). By ground clearance it is meant the vertical distance from the ground, or other platform such as a concrete pad, to the bottom edge of the radial fins. The higher ground clearances would be better suited for climates having significant accumulations of snow so that the vaporizer can clear the level of snow.

The passes may be piped in series or in a combination of series and parallel configurations. The top of one pass is piped to the top of an adjacent pass, and the bottom of a pass is piped to the bottom of an adjacent pass. Thus, cryogenic fluid enters one pass at the bottom, travels up the pass and over through the connection to an adjacent pass, down that pass and over through the connection to another pass, and so on until it exits as a gas at the temperature appropriate for the end use. The number of passes the fluid flows through, and the path of the fluid, i.e. series or combination series and parallel, will depend on various factors, such as end use temperature and flow rate requirements, ambient temperature, heat transfer characteristics, pressure drop factors and other considerations which are known to those skilled in the art.

The passes of the atmospheric vaporizer of this invention are spaced apart from one another such that the ratio of the distance between fin tips to the fin length, herein also called the spacing ratio, is from 1 to 5. For example, one embodiment of the atmospheric vaporizer of this invention employs 1 inch (2.54 cm) diameter passes spaced 13.25 inches (33.66 cm) apart centerline to centerline or 12.25 inches (31.12 cm) apart edge to edge with fins having a radial length of 3.5 inches (8.9 cm). In this case, the distance between fin tips or the gap between fins is the distance between passes minus the fin radial length on each pass, or $12.25-2(3.5)=5.25$ inches (13.34 cm) and the spacing ratio is $5.25/3.5=1.5$. This spacing ratio is calculated with reference to the two closest fins on adjacent passes.

As previously mentioned, the spacing ratio may be from 1 to 5; preferably the spacing ratio is from 2 to 4 and most preferably it is about 3. There is a sharp increase in the operating efficiency of the atmospheric vaporizer at the lower end of the defined spacing ratio range. The efficiency gradually increases and then evens out at the upper limit of the range is approached and attained. This phenomenon is shown more clearly in FIG. 9 and in the Examples.

Heretofore, atmospheric vaporizers typically employed a spacing ratio of less than 1 and generally the spacing ratio was about 0.4 or less. This is because it was felt that atmospheric vaporizers would operate at better efficiency, i.e., better heat transfer could be attained, when the passes were closer together. This invention comprises the discovery that moving the individual passes further apart than heretofore thought prudent will result, surprisingly, in an increase in efficiency when the spacing ratio is increased to 1, and that the efficiency continues to increase until the spacing ratio is increased to 5.

The passes of the atmospheric vaporizer of this invention are arranged in a square, rectangular or triangular array. FIG. 5 illustrates an array 50 of four-finned passes. Here one square array is demarcated by individual passes 51, 52, 53 and 54 at the corners of the square. FIG. 6 illustrates an array 60 of four-finned passes. Here one triangular array is demarcated by individual passes 61, 62 and 63. Another triangular array is demarcated by individual passes 62, 63 and 64. FIG. 7 illustrates an array 70 of three-finned passes. Here one square array is demarcated by individual passes 71, 72, 73 and 74.

FIG. 5 may be used to illustrate some typical modes of operating for the atmospheric vaporizer of this invention. For example, a cryogenic liquid may enter the bottom of pass 51, travel up through it and over to pass 52, down this pass and so on down the line until it is discharged as a gas from pass 55. This illustrates operation in series. Similarly, the fluid may enter pass 53 and exit pass 56, or enter pass 58 and exit pass 57. Alternatively, the inlet fluid could be combined so that the inlets of pass 51, 53 and 58 would be combined and connected to the liquid source and the outlet of pass 55, 56 and 57 would be combined so that the exit gas would all be combined for the end use. This illustrates operation in combined series and parallel flow patterns. Those skilled in the art will readily see additional ways of operating the atmospheric vaporizer of this invention by altering the fluid path simply by appropriate piping and valving.

FIG. 8 illustrates a typical atmospheric vaporizer of this invention. The front supports are shown in broken view in order to more clearly show the inlet and outlet connections. As shown in FIG. 8, liquid cryogen enters the vaporizer through inlet 81, travels up pass 82 and across piping connection 83 to pass 84, down pass 84 and across piping connection 85 to pass 86, up pass 86 and across piping connection 87 to pass 88, and down pass 88 and out outlet 89 in the form of a gas.

The passes which comprise the atmospheric vaporizer of this invention may be deployed in any suitable spatial configuration consistent with the spacing ratio defined previously. It is expected that the array of three or more passes will define an enclosed air space between them, i.e. that the passes will not all be in a straight line. Preferred arrays are rectangular or square arrays as shown in FIGS. 5 and 7 and triangular arrays as shown in FIG. 6.

The atmospheric vaporizer of this invention may also be provided with one or more control devices. One such device is to control the flow rate of the fluid. By regulating the flow of fluid, one can compensate for changes in ambient air temperature and/or system heat transfer efficiency in order to keep the exit gas temperature constant. Such an arrangement is most useful when the particular usage to which the gas is put requires a specific gas temperature or temperature range.

This invention, by employing the critical pass spacing ratio and the other defined features provides an atmospheric vaporizer which is capable of vaporizing cryogenic liquids on a continuous basis at an efficiency considerably higher than is achievable by the use of atmospheric vaporizers of the prior art.

The following examples serve to further illustrate preferred embodiments of the atmospheric vaporizer of this invention, and the greatly improved results attainable by its use over those obtained with conventional atmospheric vaporizers. The examples are intended to illustrate the invention, and are not intended to limit the scope of the invention.

EXAMPLES 1-4

An atmospheric vaporizer having four passes in a square array was employed to vaporize liquid oxygen and was evaluated to determine its flow capacity at steady state. The evaluation was conducted in a climate control house so that ambient temperature and humidity were relatively constant throughout the evaluation. The vaporizer passes were 7.5 feet (2.29 m) in height, each had a ground clearance of 1.5 feet (0.46 m), each had a center tube diameter of one inch (2.54 cm) and each was provided with eight fins. Each fin had a radial length of 3.5 inches (8.9 cm) and a thickness of 0.1 inch (0.025 cm). The pass spacing, centerline to centerline, was 13.25 inches (33.66 cm) between adjacent passes and the spacing gap, i.e. the space from fin tip to fin tip was 5.25 inches (13.3 cm). Thus, the spacing ratio was $5.25/3.5=1.5$.

The ambient temperature was kept at about 35° F. (1.6° C.) throughout the evaluation and the relative humidity was kept about 100 percent. The gas exit temperature was maintained relatively constant throughout the evaluation at about 5° F. (−15° C.) by periodically adjusting the flow through the vaporizer. As the ice and frost blanket continued to increase, the flow was adjusted downward to maintain the gas exit temperature essentially constant. After about six days of operation the vaporizer operating conditions reached steady state and the flow rate was measured. The results appear in Table 1 under Example 1.

The procedure described above was repeated except that the distance between adjacent passes was increased to 18 inches (45.7 cm) giving a spacing gap of 10 inches (25.4 cm) and a spacing ratio of 2.9. The vaporizer was evaluated for steady state flow rate and the results are shown in Table 1 under Example 2.

The above-described procedure was repeated a third time. The pass spacing again was 13 inches. However, in this example the number of fins used on each pass was four instead of eight. The vaporizer was evaluated for steady state flow rate. The results are reported in Table 1 under Example 3.

For comparative purposes the above-described procedure was repeated, but without employing the atmospheric vaporizer of this invention. The vaporizer employed herein was identical to the eight-fin vaporizer described above except that the pass spacing was only 9.25 inches (23.5 cm). The spacing gap was only 1.25 inches (3.2 cm) and the spacing ratio was only 0.4. This pass spacing is representative of the pass spacing characteristic of heretofore available atmospheric vaporizers. This vaporizer was also evaluated for steady state flow rate and the results are also reported in Table 1 under Example 4.

TABLE 1

| Example | 1 | 2 | 3 | 4 |
|---|---|---|---|---|
| Number of Fins | 8 | 8 | 4 | 8 |
| Pass spacing (inches) (cm) | 13.25 (33.66) | 18 (45.7) | 18 (45.7) | 9.25 (23.5) |
| Spacing Gap (inches) (cm) | 5.25 (13.3) | 10 (25.4) | 10 (25.4) | 1.25 (3.2) |
| Spacing Ratio | 1.5 | 2.9 | 2.9 | 0.4 |
| Flow Capacity ($Ft^3$/hour) ($m^3$/hr) | 385 (35.8) | 465 (43.2) | 350 (32.5) | 245 (22.8) |

As shown in Table 1 there is a sharp increase in steady state flow rate when the atmospheric vaporizer of this invention is employed over that obtained in the comparative example wherein the atmospheric vaporizer of this invention was not employed. This increase in steady state flow rate is indicative of the increase in operating efficiency.

Comparison of Example 1 with Example 4 demonstrates that the increase in pass spacing ratio from 0.4 to 1.5 results in an increase in steady state flow capacity of 57 percent. Comparison of Example 2 with Example 4 demonstrates that the increase in pass spacing ratio from 0.4 to 2.9 results in an increase in steady state flow capacity of 90 percent. Comparison of Example 3 with Comparative Example 4 demonstrates that even though the fin number per pass was reduced from 8 to 4 resulting in a decrease in the heat transfer area of about 50 percent, an increase in pass spacing ratio from 0.4 to 2.9 results in an increase in steady state flow capacity of 43 percent.

The results of these examples are shown graphically in FIG. 9; curve E represents the results employing the vaporizer provided with 8 fins per pass and curve F represents the results employing the vaporizer provided with 4 fins per pass.

What is claimed is:

1. An apparatus for continuously vaporizing a cryogenic liquid by employing heat absorbed from the ambient air comprising at least three substantially vertical positioned passes which are piped together each pass being comprised of a center tube having an outside diameter of from 0.5 to 1.5 inches and provided with 3 to 8 fins substantially equally spaced around said tube, each fin having a radial length of from 1.5 to 7 times the outside diameter of said tube and extending longitudinally along substantially the entire length of said tube, each pass having a length of from 5 to 20 feet and a ground clearance of from 1 to 4 feet, and wherein the ratio of the distance between adjacent fin tips to radial fin length is from 1 to 5 to define a substantially open space between adjacent fin tips.

2. An atmospheric vaporizer as claimed in claim 1 wherein said ratio is from 2 to 4.

3. An atmospheric vaporizer as claimed in claim 1 wherein said ratio is about 3.

4. An atmospheric vaporizer as claimed in claim 1 wherein said passes are arranged in a square array.

5. An atmospheric vaporizer as claimed in claim 1 wherein said passes are arranged in a triangular array.

6. An atmospheric vaporizer as claimed in claim 1 wherein said passes are provided with 3 fins.

7. An atmospheric vaporizer as claimed in claim 1 wherein said passes are provided with 4 fins.

8. An atmospheric vaporizer as claimed in claim 1 wherein said passes are provided with 8 fins.

9. An atmospheric vaporizer as claimed in claim 1 wherein said fin radial length is about 3.5 times the outside diameter of the center tube.

10. An atmospheric vaporizer as claimed in claim 1 wherein said passes have a ground clearance of from 1.5 to 3 feet.

11. An atmospheric vaporizer as claimed in claim 1 wherein said center tube outside diameter is about 1 inch.

12. An atmospheric vaporizer as claimed in claim 1 wherein said pass length is from 8 to 16 feet.

13. An atmospheric vaporizer as claimed in claim 1 wherein said pass length is about 12 feet.

* * * * *